United States Patent [19]

Guinn

[11] 4,447,060

[45] May 8, 1984

[54] TARGET GAME

[76] Inventor: Kenneth F. Guinn, 7313 Briley Dr., Fort Worth, Tex. 76118

[21] Appl. No.: 440,944

[22] Filed: Nov. 12, 1982

[51] Int. Cl.[3] ..... A63B 67/06

[52] U.S. Cl. ..... 273/346; 273/425

[58] Field of Search ..... 273/345–347, 273/424, 425

[56] References Cited

U.S. PATENT DOCUMENTS

| | | | |
|---|---|---|---|
| 3,032,345 | 5/1962 | Lemelson | 273/95 |
| 3,967,823 | 7/1976 | Yount | 273/346 |
| 4,305,587 | 12/1981 | O'Grady | 273/345 |

FOREIGN PATENT DOCUMENTS

| | | | |
|---|---|---|---|
| 2401234 | 7/1975 | Fed. Rep. of Germany | 273/346 |
| 17455 | of 1899 | United Kingdom | 273/346 |

*Primary Examiner*—Paul E. Shapiro
*Attorney, Agent, or Firm*—James E. Bradley

[57] ABSTRACT

A target game which has a target having an outer face provided with a loop type of contact engaging material and a projectile for use in a target game. The projectile comprises an inner disk having inside and outside faces, a central opening, and a ring-shaped outer periphery. The outside face is provided with a hook type of contact engaging material adapted to engage the target. A cup member having a base with cylindrical sidewalls extending therefrom receives the inner disk with the ring-shaped outer periphery of the inner disk contacting the interior of the cup member sidewalls. The cup member has a central projection which is received within the disk central opening. The cup member base is formed of a complimentary loop type of contact engaging material for engaging the contact engaging material on the inner disk. An inner cylinder is received in the disk central opening over the cup member central projection and an outer cylinder is slidingly received over the disk outer periphery and over the cup member cylindrical sidewalls.

3 Claims, 4 Drawing Figures

TARGET GAME

BACKGROUND OF THE INVENTION

The present invention relates generally to games and amusement devices in which a projectile is hurled toward a target surface and specifically to a target game provided with means for securing the projectile onto the surface of a target by contact engagement of the projectile and target surface materials.

Various types of target games are known which utilize missiles, balls, darts, and the like which become secured to a target for indicating the position of the projectile on the target. Older target games such as dart games utilized a pointed steel needle or blade secured to the nose of the missile which penetrated the surface of the target and held the missile in place. In later versions of the game, a rubber friction cup was substituted for the pointed steel needle to secure the missile to the target surface. Both designs were less than satisfactory since the steel tipped dart is generally dangerous for less skilled users or children, and while the suction cup dart is relatively safe, the sticking action of the cup to the target surface is less than satisfactory.

In recent years, a contact engaging type material has come into use which features a first type of contact engaging material made of a multitude of short filaments of synthetic plastic such as nylon which are adapted to mesh with and interlock against a second contact engaging type material which is made of a multitude of short wire-like filaments which are shaped to become hooked with the filaments of the first type material. These materials are presently commercially available under the name of Velcro manufactured by the Velcro Corporation, New York City, N.Y.

With the advent of Velcro, various target games have been proposed in which a projectile such as a ball has strips of the hook type members affixed thereon which is thrown toward a target surface of the mating mesh loop type material. Such games are safe as compared to steel tipped darts and adhere to the target surface much more readily and with a lesser amount of force than did the suction cup tipped devices. In spite of these advances, certain disadvantages remained with the prior target game devices. For instance, the prior devices were not well adapted to target games in which it was desired to "stack" succeeding projectiles in order to cancel out earlier throws.

SUMMARY OF THE INVENTION

The present target game includes a target having an outer face provided with a first type of contact engaging material and a projectile member having a side provided with a second type of contact engaging material for engaging the target outer face and having an opposite side provided with the first type of contact engaging material.

Preferably the target outer face contact engaging material comprises a pile-like fabric formed of upstanding loops. The projectile member target side preferably comprises a multitude of outwardly extending hook-like members and the projectile member opposite side is provided with the pile-like fabric formed of upstanding loops for engaging the target side of an additional projectile member.

The projectile member for use in a target game of the invention preferably comprises an inner disk having inside and outside faces, a central opening, and a ring-shaped outer periphery, the outside face being provided with a contact engaging material adapted to engage the target. A cup member having a base with cylindrical sidewalls extending therefrom is adapted to receive the inner disk with the ring-shaped outer periphery of the inner disk contacting the interior of the cup member sidewalls. The cup member has a central projection which is adapted to be received within the disk central opening. The cup member base is formed of a complimentary type of contact engaging material for engaging the contact engaging material on the inner disk. An inner cylinder is adapted to be received in the disk central opening over the cup member central projection and an outer cylinder is adapted to be slidingly received over the disk outer periphery and over the cup member cylindrical sidewalls.

In the method of playing a target game of the invention, a target is first erected having an outer face provided with a first type of contact engaging material. A projectile member is then thrown toward the target, the projectile member having a target side provided with a second type of contact engaging material for engaging the target outer face and having an opposite stacking side provided with the first type of contact engaging material. Additional projectile members are then thrown toward the engaged projectile members to engage the additional member target sides with the engaged member stacking side.

Additional features, objects, and advantages will be apparent in the written description which follows.

DETAILED DESCRIPTION OF THE INVENTION

Figure 1:
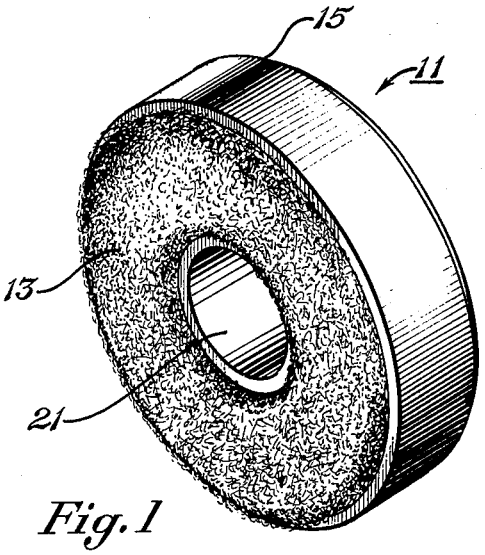
FIG. 1 is a perspective view of a projectile of the invention shown the stacking side.
Figure 2:
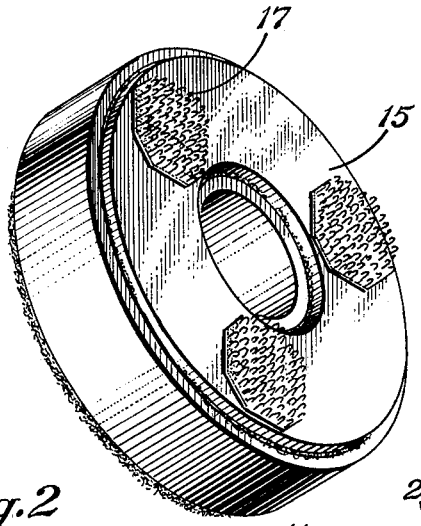
FIG. 2 is a perspective view of the projectile of FIG. 1 showing the opposite target engaging side of the projectile.

Turning to FIG. 1, there is shown a projectile designated generally as 11 for use in the target game of the invention. The projectile 11 has a side 13 provided with a first type of contact engaging material. A suitable contact engaging material is provided in the form of a pile-like fabric formed of upstanding loops. The projectile 11, as shown in FIG. 2, also has a side 15 opposite side 13 which is provided with a second type of contact engaging material 17 which can be provided as a multitude of outwardly extending hook-like members. The first and second contact engaging type materials described are commercially available under the name "Velcro" manufactured by the Velcro Corporation, New York City, N.Y.

Velcro materials have generally been used in the past for clothing closure means to replace zippers and snaps. A typical closure unit would consist of two strips of flexible wool-like material, one of which has a multitude of tiny monofilament hooks protruding from its surface and the other material consisting of a flexible band having a multitude of tiny wire-like filaments sewn thereto into a multitude of loops, each of which protrudes outwardly from the surface of the material. When the surfaces of the materials are brought together, the hooks become engaged in the loops in a random manner and provide a means for holding one of the materials against the other by contact between the two.

Figure 3:
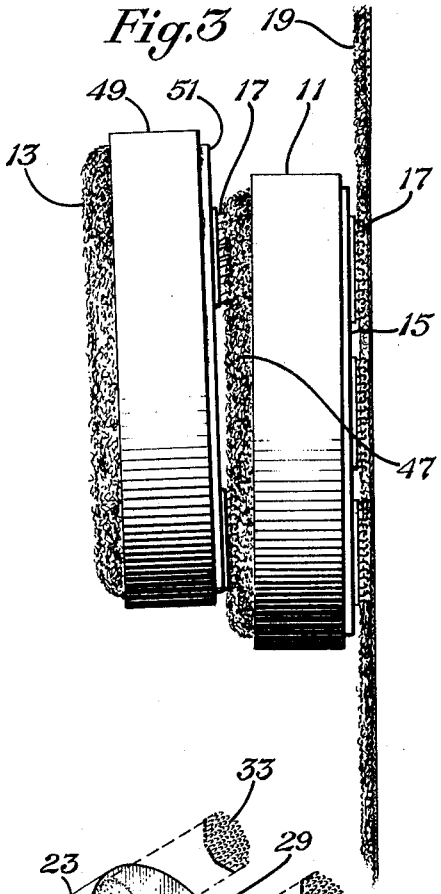
FIG. 3 is a side view of two projectile members of the invention engaged on the target in stacking fashion.

As shown in FIG. 3, the projectile 11 is adapted to be hurled toward and engaged with a target having an outer face 19 which is provided with the first loop-type contact engaging material.

Figure 4:
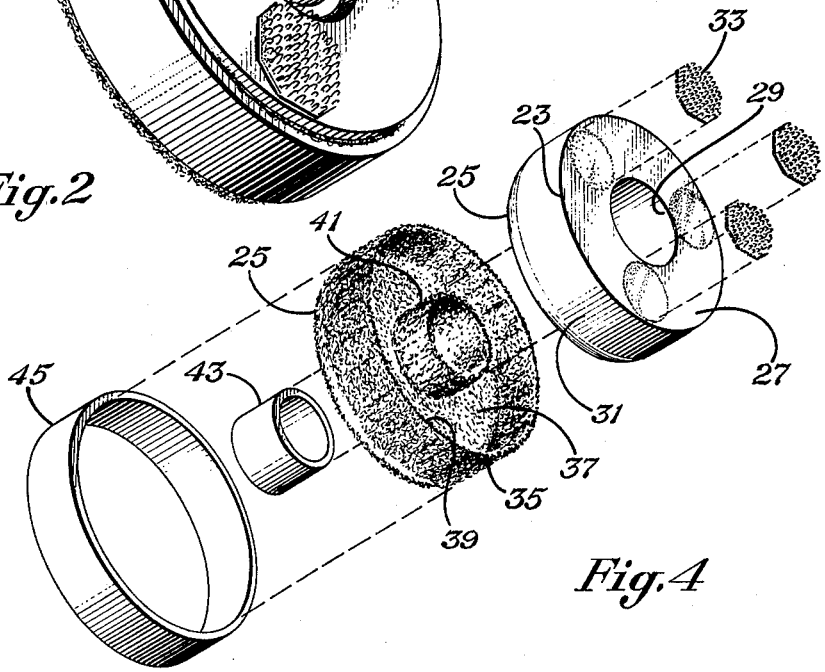
FIG. 4 is an exploded view of the projectile member of FIG. 1 showing the assembly thereof.

As shown in FIGS. 1 and 4, the projectile 11 is preferably a disk-shaped member and is provided with a central opening 21 which passes between the target side 15 and the opposite stacking side 13 of the projectile member. The projectile 11, as best seen in FIG. 4, is assembled from an inner disk 23 having an inside and outside faces 25, 27, a central opening 29 and a ring-shaped outer periphery 31. The outside face 27 is provided with the second type of contact engaging material having the hook members which are adapted to engage the target outer face which is provided with the first type of contact engaging material made of the loop members. Although the outside face 27 can be covered with the hook material 17, it has been found sufficient to provide the contact engaging material as spaced-apart patches 33 which can conveniently be glued to the disk outside face 27. Preferably three such spaced-apart patches 33 are secured about the circumference of the central opening 29 in equidistant fashion. The inner disk 23 can be manufactured of a high density plastic for economy and lightweight design.

A cup member 35 is provided having a base 37 with cylindrical sidewalls 39 extending upwardly therefrom which is adapted to receive the inner disk 23 with the ring-shaped outer periphery 31 of the inner disk 23 contacting the interior of the cup member cylindrical sidewalls 39. The cup member 35 also has a central projection 41 which is adapted to be slidingly received within the inner disk central opening 29. The cup member base 37 is formed of a complimentary type of contact engaging material, preferably the loop type material, for engaging the hook-like contact engaging material 17 on the inner disk outer face 27.

An inner cylinder 43 is adapted to be slidingly received within the disk central opening 29 over the cup member central projection 41. That is, the inner disk 23 is first placed within the cup member 35 with the cup member projection 41 being slidably received within the inner disk central opening 29. The inner cylinder 43 is then slidingly received within the projection 41 thereby snugly engaging the projection 41 and hence the cup member 35 to the inner disk 23. An outer cylinder 45 is adapted to be slidingly received over the disk outer periphery 31 and over the cup member cylindrical sidewalls 39 to further engage the cup member with the disk 23.

The method of playing a target game with the components of the present invention is best illustrated with reference to FIG. 3. A target having an outer face 19 provided with a first type of contact engaging material, such as the loop type Velcro material is first erected on a support surface. A projectile member 11 is then hurled toward the target face 19, the projectile member 11 having a target side 15 provided with a second type of hook containing contact engaging material 17 for engaging the target outer face 19 and having an opposite stacking side 47 provided with the first type of loop containing Velcro material. Additional projectile members 49 can then be hurled toward the target face 19 or toward the engaged projectile members 11 to engage the additional projectile member target sides 51 with the engaged projectile member stacking sides 13. In this way, additional projectile members can be "stacked" to cancel out earlier throws.

An invention has been provided with significant advantages. The projectile members of the present invention are safe for even small children to use and adhere to the target surface with a minimum of force even upon striking the target surface at other than right angles. The central opening in the projectile member provides improved aerodynamic properties for the projectile to increase accuracy and ease of throwing. The disk-shaped, doughnut type design of the projectile members provides a unique challenge since only opposing type materials will adhere and score points by sticking to the target surface. By providing stacking surfaces on the projectiles, subsequent throws can be used for canceling previous efforts. The projectile members can be manufactured from plastic and Velcro material at a fraction of the cost of steel tipped darts and other prior designs.

While the invention has been shown in only one of its forms, it is not thus limited but is susceptible to various changes and modifications without departing from the spirit thereof.

I claim:

1. A projectile member for use in a target game, comprising:

an inner disk having inside and outside faces, a central opening, and a ring-shaped outer periphery, said outside face being provided with a contact engaging material adapted to engage the target;

a cup member having a base with cylindrical sidewalls extending therefrom adapted to receive said inner disk with the ring-shaped outer periphery of said inner disk contacting the interior of said cup member sidewalls, said cup member having a central projection which is adapted to be received within said disk central opening, said cup member base being formed of a complimentary type of contact engaging material for engaging said contact engaging material on said inner disk;

an inner cylinder adapted to be received in said disk central opening over said cup member central projection; and an outer cylinder adapted to be slidingly received over said disk outer periphery and over said cup member cylindrical sidewalls.

2. The projectile of claim 1, wherein said inner disk contact engaging material is comprised of a multitude of outwardly extending hook-like members and said cup member complimentary contact engaing material is a pile-like fabric formed of upstanding loops.

3. The projectile of claim 2, wherein said inner disk contact engaging material is provided as spaced-apart patches on said disk outside face.

* * * * *